US009358408B2

(12) United States Patent
Hua

(10) Patent No.: US 9,358,408 B2
(45) Date of Patent: Jun. 7, 2016

(54) PORTABLE POWERED ROPE CLIMBING DEVICE AND METHOD THEREOF

(75) Inventor: Lin Hua, Zhejiang (CN)

(73) Assignee: Hangzhou Shtech Co., Ltd., Hangzhou (CN)

( * ) Notice: Subject to any disclaimer, the term of this patent is extended or adjusted under 35 U.S.C. 154(b) by 104 days.

(21) Appl. No.: 13/982,055

(22) PCT Filed: Jul. 2, 2011

(86) PCT No.: PCT/CN2011/076789

§ 371 (c)(1),
(2), (4) Date: Jul. 26, 2013

(87) PCT Pub. No.: WO2012/151780

PCT Pub. Date: Nov. 15, 2012

(65) Prior Publication Data

US 2013/0306923 A1 Nov. 21, 2013

(30) Foreign Application Priority Data

May 12, 2011 (CN) ..... 2011 1 0122320

(51) Int. Cl.

| | |
|---|---|
| ***B66D 3/18*** | (2006.01) |
| ***A62B 1/14*** | (2006.01) |
| ***A62B 1/06*** | (2006.01) |
| ***A63B 29/00*** | (2006.01) |
| *A63B 29/02* | (2006.01) |

(52) U.S. Cl.

CPC ... *A62B 1/14* (2013.01); *A62B 1/06* (2013.01); *A63B 29/00* (2013.01); *B66D 3/18* (2013.01); *A63B 29/02* (2013.01)

(58) Field of Classification Search

USPC ..... 254/393, 394, 397

See application file for complete search history.

(56) References Cited

U.S. PATENT DOCUMENTS

| | | | | |
|---|---|---|---|---|
| 3,608,864 | A * | 9/1971 | Dargitz et al. | 254/274 |
| 3,680,839 | A * | 8/1972 | Mattinson | 254/310 |
| 3,984,083 | A * | 10/1976 | McElroy | 254/342 |
| 4,634,102 | A * | 1/1987 | Appling et al. | 254/278 |
| 4,811,669 | A * | 3/1989 | Dahlman | 105/30 |
| 4,851,980 | A * | 7/1989 | McWilliams et al. | 362/403 |
| 5,380,258 | A * | 1/1995 | Hawley, Jr. | 482/37 |
| 5,701,972 | A | 12/1997 | Bloder | |
| 7,448,597 | B2 * | 11/2008 | Jacobson et al. | 254/274 |

(Continued)

FOREIGN PATENT DOCUMENTS

| | | |
|---|---|---|
| CN | 2726641 Y | 9/2005 |
| CN | 2892819 Y | 4/2007 |
| CN | 201533952 U | 7/2010 |

*Primary Examiner* — Emmanuel M Marcelo

(74) *Attorney, Agent, or Firm* — Ladas & Parry LLP

(57) ABSTRACT

The invention is a portable powered rope climbing device, which can carry persons and objects to ascend or descend along a climbing rope, and ensure controllable speed. The invention comprises a battery pack, an electromagnetic brake direct current motor, and an output shaft of the motor connected with an input shaft of a reducer. An output shaft of the reducer and the input shaft of the reducer are arranged in a 90-degree manner. A driving rope pulley is fixed to the output shaft of the reducer. A climbing rope is wound inside the driving rope pulley. A warping brake rope-pressing pulley block and rope-pressing pulleys tightly press the climbing rope. The climbing rope is wound between the driving rope pulley and a reversing rope pulley and is led out of the driving rope pulley. A speed control module is connected with the motor.

9 Claims, 2 Drawing Sheets

(56) References Cited

U.S. PATENT DOCUMENTS

2006/0017047 A1* 1/2006 Calver ..... 254/411
2006/0231812 A1* 10/2006 Ziech et al. ..... 254/278
2008/0157042 A1* 7/2008 Jacobson et al. ..... 254/270
2010/0041520 A1 2/2010 Popescu

* cited by examiner

PORTABLE POWERED ROPE CLIMBING DEVICE AND METHOD THEREOF

RELATED APPLICATION INFORMATION

This application is a 371 of International Application PCT/CN2011/076789 filed 2 Jul. 2011 entitled "Portable Powered Rope Climbing Device and Method Thereof", which was published 15 Nov. 2012, with International Publication Number WO 2012/151780 A1, and which claims priority from Chinese Application No.: 201110122320.0 filed 12 May 2011, the contents of which are incorporated herein by reference.

TECHNICAL FIELD

The present invention relates to a portable powered rope climbing device, which can not only carry persons and objects to ascend or descend along a climbing rope, but also ensure controllable ascending or descending speed, and a rope climbing method thereof; the portable powered rope climbing device is mainly used for high-rise escape, mountain exploration, military climbing and the like, and belongs to the powered rope climbing device manufacturing field.

BACKGROUND

Disclosed in CN1046682 A entitled 'Rope Climbing Device' is a rope climbing device, the rope climbing devices are hung in pair on a steel cable, steel rope, rope or slender pole suspended in the air, and by alternate operation of hands and legs, human body is able to ascend or descend along the rope and stay at any location on the rope; this rope climbing device is characterized in that, the device comprises paired groove pulleys that are tightly jointed at their peripheries and capable of rotation in opposite directions, wherein a cam groove, an eccentric channel or a non-isodiametric annular groove is carved on the middle of the periphery of one or two groove pulleys, a hole for consecutive passage of the rope is formed at the tight jointing spot on the periphery of each groove pulley, the size of the hole is variable as the groove pulley is rotated, the device can slide up and down along the rope when the hole becomes larger and can clamp the rope tightly to stay at any specified location without falling when the hole becomes smaller. The rope climbing device has such a shortcoming that: the rope climbing device is a mechanical climbing device that requires matching of human hands and legs and ascends along a rope or a pole based upon human strength, besides, locking between the rope climbing device and the rope or the pole is achieved through hand and leg operations, therefore, inconvenient operation and limited ascending and descending heights are brought, and it is difficult to ensure its safety and reliability.

SUMMARY OF THE INVENTION

Design objective: to avoid the shortcomings in the prior art, a portable powered rope climbing device, which can not only carry persons and objects to ascend or descend along a climbing rope, but also ensure controllable ascending or descending speed, and a rope climbing method thereof are designed.

Design scheme: to achieve the above design objective. 1. Design of a driving rope pulley and a reversing rope pulley is one of the technical features of the present invention. The purpose of this is that: the pulley grooves of the driving rope pulley and the reversing rope pulley are changed into annular rope pulleys by respective division into two or more grooves and the annular rope pulleys are separated from each other by an annular partition, in addition, the climbing rope between the annular rope groove in the driving rope pulley and the annular rope groove in the reversing rope pulley performs rope groove-over spiral matching rotation, thus forcing the climbing rope not to carry out relative sliding in relation to the driving rope pulley. 2. Such a design that the middle of the warping brake rope-pressing pulley block is located at the upper part at one side of the driving rope pulley via a pin shaft is the second technical feature of the present invention. The purpose of this is that: under the action of the force-applied climbing rope, the rope-pressing pulleys at two ends of the warping brake rope-pressing pulley block can not only warp the rope-pressing pulley at one end of the warping brake rope-pressing pulley block, but also presses downwards the rope-pressing pulley at the other end of the warping brake rope-pressing pulley block, so that the pulley faces of the rope-pressing pulleys tightly press the pulley face of the driving rope pulley and also the climbing rope wound on the driving rope pulley, in order to increase the friction forces and avoid the impact of gravity on the electromagnetic brake direct current motor. 3. Design of the electromagnetic brake direct current motor with a power-off brake mode is the third technical feature of the present invention. The purpose of this is that: the power-off brake-type electromagnetic brake direct current motor is regarded as a simulation-free magnetomotive-type electromagnetic brake in the aspect of structural design, so it is able to generate a brake force upon power failure to guarantee instantaneous brake of the rope climbing device and the safety of person and object. 4. Design of the speed control module is the fourth technical feature of the present invention. The purpose of this is that: the speed control module is connected in shunt with the signal terminal of the brake-type electromagnetic brake direct current motor, so in case that the brake-type electromagnetic brake direct current motor is under power failure, a brush direct current tubular motor can stably descend at a constant speed by the speed control module (a speed control module for the brush direct current tubular motor) on condition that a person or an object is hung on the rope climbing device.

Technical scheme 1: a portable powered rope climbing device comprises a battery pack, the main body of the rope climbing device is equipped with an electromagnetic brake direct current motor, the output shaft of the electromagnetic brake direct current motor is connected with the input shaft of a reducer, the output shaft of the reducer and the input shaft of the reducer are arranged in a 90-degree manner and a driving rope pulley is fixed to the output shaft of the reducer, a climbing rope is wound inside a rope groove of the driving rope pulley, the middle part of a warping brake rope-pressing pulley block is positioned at the upper part at one side of the driving rope pulley through a shaft pin and rope-pressing pulleys at two ends of the warping brake rope-pressing pulley block tightly press the climbing rope in a warping manner, a reversing rope pulley is positioned above the other side of the driving rope pulley and a rope groove in the reversing rope pulley is matched with the rope groove in the driving rope pulley, the climbing rope is continuously wound between the rope groove of the driving rope pulley and the rope groove of the reversing rope pulley and is led out of the rope groove of the driving rope pulley, a speed control module is positioned on the main body, and the signal output terminal of the speed control module is connected with the signal input terminal of the electromagnetic brake direct current motor.

Technical scheme 2: A rope climbing method of the portable powered rope climbing device: when a person or an object descends from a high place or ascends from a low place, the person holds the handle of the rope climbing device with two hands, the person sits on or the object is hung on a rope seat connected with the rope climbing device, a falling force to the main body of the rope climbing device is generated due to the gravity of the person or the object, this falling force causes the upper rope-pressing pulley in the warping brake rope-pressing pulley block of the rope climbing device to warp under the action of the climbing rope, and simultaneously, causes the lower rope-pressing pulley to tightly press the climbing rope and form a tension and a pressure for the climbing rope, in this way, friction forces between the upper and lower rope-pressing pulleys in the warping brake rope-pressing pulley block and the climbing rope are increased, so that the pulley face of the upper rope-pressing pulley tightly presses the climbing rope in a rolling manner and the pulley face of the lower rope-pressing pulley rolls in relation to the excircle of the driving rope pulley, which leads to no relative sliding of the climbing rope on the driving rope pulley; ascending and descending operation buttons and a stop button are arranged on the handle, so when the person completes the operation of the ascending or descending button with any of the two hands or remote control is accomplished by other people via a remote controller, the electromagnetic brake direct current motor can be controlled by the speed control module and drives the driving rope pulley by 90-degree reversal of the reducer to drive the rope climbing device to ascend or descend, and the stop button is pressed in case of reaching a destination.

Compared with the prior art, the present invention has the advantages that: 1, the rope climbing device can not only carry persons and objects to ascend or descend along a climbing rope, but also ensure controllable ascending or descending speed; 2, ascending and descending as well as brake of the rope climbing device can be controlled by the electromagnetic brake direct current motor, furthermore, safe, stable and constant-speed ascending and descending of the electromagnetic brake direct current motor under power failure can be realized by the speed control module while brake of the electromagnetic brake direct current motor under power failure is realized; and 3, by matching of the warping brake rope-pressing pulley block and the driving rope pulley, the situation that an object falls freely is radically solved and impact of the object on the electromagnetic brake direct current motor is avoided.

DETAILED DESCRIPTION OF THE EMBODIMENTS

Embodiment 1

Figure 1:
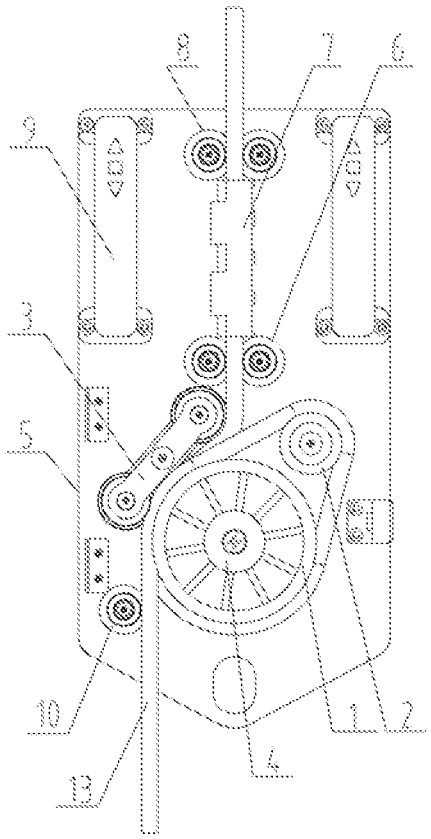
FIG. 1 is a front structure view of the portable powered rope climbing device.
Figure 2:
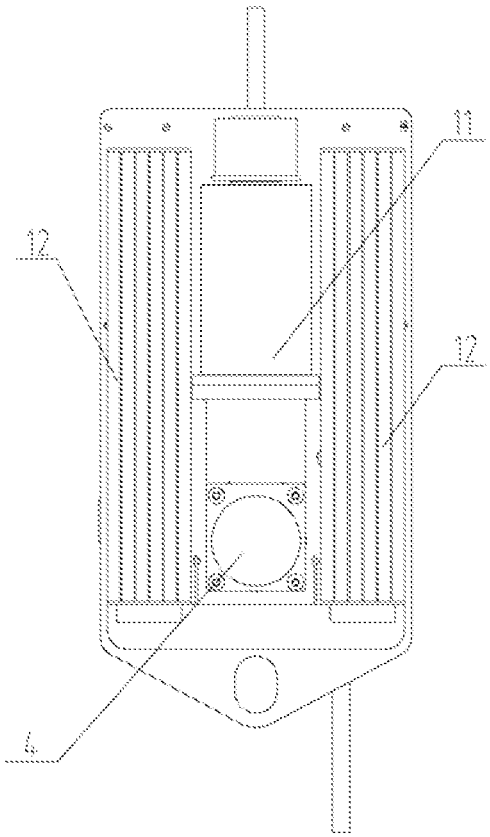
FIG. 2 is a rear structure view of FIG. 1.
Figure 3:
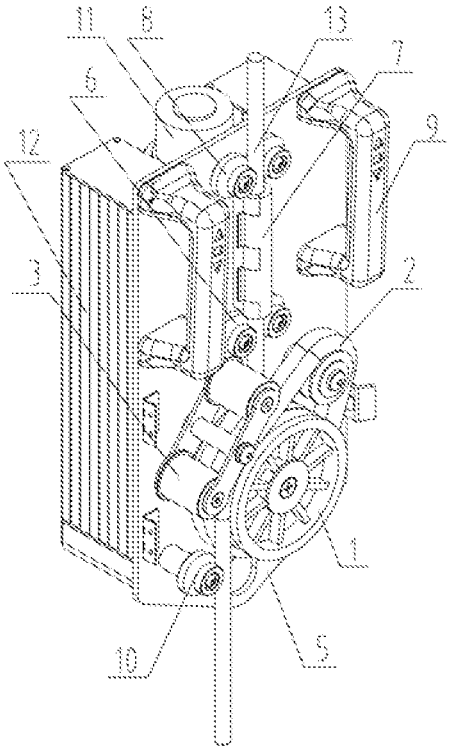
FIG. 3 is a three-dimensional structure view of FIG. 1.

Referring to FIG. 1-FIG. 4, the portable powered rope climbing device comprises a battery pack 12, the battery pack 12 is a rechargeable battery pack, the main body 5 of the rope climbing device is equipped with an electromagnetic brake direct current motor 11, the output shaft of the electromagnetic brake direct current motor 11 is connected with the input shaft of a reducer 4, the output shaft of the reducer 4 and the input shaft of the reducer 4 are arranged in a 90-degree manner and a driving rope pulley 1 is fixed to the output shaft of the reducer 4, a climbing rope 13 is wound inside a rope groove of the driving rope pulley 1, the middle part of a warping brake rope-pressing pulley block 3 is positioned at the upper part at one side of the driving rope pulley 1 through a shaft pin and rope-pressing pulleys 3-1 and 3-4 at two ends of the warping brake rope-pressing pulley block 3 tightly press the climbing rope 13 in a warping manner, a reversing rope pulley 2 is positioned above the other side of the driving rope pulley 1 and a rope groove in the reversing rope pulley 2 is matched with the rope groove in the driving rope pulley 1, the climbing rope 13 is continuously wound between the rope groove of the driving rope pulley 1 and the rope groove of the reversing rope pulley 2 and is led out of the rope groove of the driving rope pulley 1, a speed control module 9 is positioned on the main body 5, and the signal output terminal of the speed control module 9 is connected with the signal input terminal of the electromagnetic brake direct current motor 11. The speed control module (i.e. the speed control module for brush direct current tubular motor) pertains to the prior patent application of this applicant, and description is not made to its detailed circuit structure herein.

Figure 4:
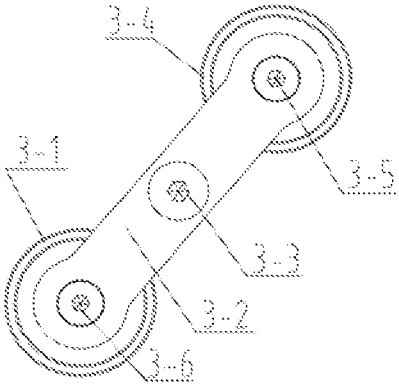
FIG. 4 is a structure view of the warping brake rope-pressing pulley block.

Referring to FIG. 4, the warping brake rope-pressing pulley block 3 consists of two rope-pressing pulleys 3-1 and 3-4, a connecting plate 3-2 for the two rope-pressing pulleys 3-1 and 3-4 and a middle shaft pin 3-3, the two rope-pressing pulleys 3-1 and 3-4 are connected with two ends of the connecting plate 3-2 respectively through pin shafts 3-5 and 3-6, the middle shaft pin 3-3 is positioned inside a shaft hole on the middle of the connecting plate 3-2 and the shaft hole of the connecting plate 3-2 is rotated about the middle shaft pin 3-3.

When there are N rope grooves of the driving rope pulley 1, the number of the rope grooves in the reversing rope pulley 2 is N−1, wherein N=3, 4, 5 and 6, that is to say, the pulley faces of the driving rope pulley 1 and the reversing rope pulley 2 are each partitioned into a plurality of annular rope grooves, but the number of the rope grooves of the pulley face of the reversing rope pulley 2 is less than the number of the rope grooves of the pulley face of the driving rope pulley 1 by one.

A rope guide sheath 7 is arranged above the driving rope pulley 1 in order to prevent the climbing rope from tangling with other components, rope guide pulley blocks 6 and 8, with two pulley faces being opposite to each other, are arranged at two ends of the rope guide sheath 7 respectively, and the climbing rope 13 passes through the two pulley faces.

A rope guide pulley 10 is arranged below the lower rope-pressing pulley of the warping brake rope-pressing pulley block 3, in order to guide the operation of the climbing rope and enable the climbing rope to slide.

Control buttons for the speed control module 9 are arranged on a handle, in order to help the user keep body balance and facilitate the use and operation of the rope climbing device.

The battery pack 12 consists of two batteries that are arranged at two sides of the electromagnetic brake direct current motor 11 in the main body 5.

Embodiment 2

Based on the embodiment 1, a rope climbing method of the portable powered rope climbing device is provided; when a person or an object descends from a high place or ascends from a low place, the person holds the handle of the rope climbing device with two hands, the person sits on or the object is hung on a rope seat connected with the rope climbing device, a falling force to the main body 5 of the rope climbing device is generated due to the gravity of the person or the object, this falling force causes the upper rope-pressing pulley 3-2 in the warping brake rope-pressing pulley block 3 of the rope climbing device to warp under the action of the climbing rope, and simultaneously, causes the lower rope-pressing pulley 3-1 to tightly press the climbing rope 13 and form a tension and a pressure for the climbing rope 13, in this way, friction forces between the upper and lower rope-pressing pulleys 3-1 and 3-2 in the warping brake rope-pressing pulley block 3 and the climbing rope are increased, the pulley face of the upper rope-pressing pulley tightly presses the climbing rope in a rolling manner and the pulley face of the lower rope-pressing pulley rolls in relation to the excircle of the driving rope pulley 1, thus there is no relative sliding of the climbing rope on the driving rope pulley 1; ascending and descending operation buttons and a stop button are arranged on the handle, so when the person completes the operation of the ascending or descending button with any of the two hands or remote control is accomplished by other people via a remote controller, the electromagnetic brake direct current motor 11 can be controlled by the speed control module 9 and drives the driving rope pulley 1 by 90-degree reversal of the reducer 4 to drive the rope climbing device to ascend or descend, and the stop button is pressed after a destination is reached. Groove-over spiral matching rotation needs to be carried out between the climbing rope 13 in the driving rope pulley 1 and the reversing rope pulley 2, which forces the climbing rope 13 not to carry out relative sliding in relation to the driving rope pulley 1. To facilitate entrance and exit of the rope into and out of the driving rope pulley, gaps between the upper and lower rope-pressing pulleys in the warp brake rope-pressing pulley block 3 and the driving rope pulley 1 are larger than the diameter of the climbing rope.

It shall be understood that: while the present invention has been described in details in the aforementioned embodiments, this description is a simple one for the design concept of the present invention only, not limitation thereto, and any combination, addition or modification that is not beyond the design concept of the present invention shall fall within the scope of the present invention.

The invention claimed is:

1. A portable powered rope climbing device, comprising a battery pack, characterized in that: a main body of the rope climbing device is equipped with an electromagnetic brake direct current motor, an output shaft of the electromagnetic brake direct current motor is connected with an input shaft of a reducer, an output shaft of the reducer and the input shaft of the reducer are arranged in a 90-degree manner and a driving rope pulley is fixed to the output shaft of the reducer, a climbing rope is wound inside a rope groove of the driving rope pulley, a part of a warping brake rope-pressing pulley block is positioned at an upper part at one side of the driving rope pulley through a shaft pin and rope-pressing pulleys at two ends of the warping brake rope-pressing pulley block tightly press the climbing rope in a warping manner, a reversing rope pulley is positioned above the other side of the driving rope pulley and a rope groove in the reversing rope pulley is matched with the rope groove in the driving rope pulley, the climbing rope is continuously wound between the rope groove of the driving rope pulley and the rope groove of the reversing rope pulley and is led out of the rope groove of the driving rope pulley, a speed control module is positioned on the main body, and a signal output terminal of the speed control module is connected with a signal input terminal of the electromagnetic brake direct current motor, the device further comprising a rope guide sheath arranged above the driving rope pulley, rope guide pulley blocks, with two pulley faces being opposite to each other, being arranged at two ends of the rope guide sheath, and the climbing rope passing through the two pulley faces.

2. The portable powered rope climbing device according to claim 1, characterized in that: the warping brake rope-pressing pulley block consists of two rope-pressing pulleys, a connecting plate for the two rope-pressing pulleys and a shaft pin, the two rope-pressing pulleys are connected with two ends of the connecting plate respectively through pin shafts, the middle shaft pin is positioned inside a shaft hole on the middle of the connecting plate and the shaft hole of the connecting plate is rotated about the middle shaft pin.

3. The portable powered rope climbing device according to claim 1, characterized in that: when there are N rope grooves of the driving rope pulley, the number of the rope grooves in the reversing rope pulley is N−1, wherein N=3, 4, 5 and 6.

4. The portable powered rope climbing device according to claim 1, characterized in that: a rope guide pulley is arranged below a lower rope-pressing pulley of the warping brake rope-pressing pulley block.

5. The portable powered rope climbing device according to claim 1, characterized in that: control buttons for the speed control module are arranged on a handle.

6. The portable powered rope climbing device according to claim 1, characterized in that: the battery pack consists of two batteries that are arranged at two sides of the electromagnetic brake direct current motor in the main body.

7. A rope climbing method of a portable powered rope climbing device, characterized in that: when a person or an object descends from a high place or ascends from a low place, the person holds a handle of the rope climbing device with two hands, the person sits on or the object is hung on a rope seat connected with the rope climbing device, a falling force to a main body of the rope climbing device is generated due to the gravity of the person or the object, this falling force causes an upper rope-pressing pulley in a warping brake rope-pressing pulley block of the rope climbing device to warp under the action of a climbing rope, and simultaneously, causes a lower rope-pressing pulley to tightly press the climbing rope and form a tension and a pressure for the climbing rope, in this way, friction forces between the upper and lower rope-pressing pulleys in the warping brake rope-pressing pulley block and the climbing rope are increased, a pulley face of the upper rope-pressing pulley tightly presses the climbing rope in a rolling manner and a pulley face of the lower rope-pressing pulley rolls in relation to a excircle of a driving rope pulley above which a rope guide sheath is arranged, rope guide pulley blocks, with two pulley faces being opposite to each other, being arranged at two ends of the rope guide sheath, such that the climbing rope passing through the two pulley faces so that there is no relative sliding of the climbing rope on the driving rope pulley; ascending and descending operation buttons and a stop button are arranged on the handle, so when the person completes the operation of the ascending or descending button with any of the two hands or remote control is accomplished by other people via a remote controller, an electromagnetic brake direct current motor can be controlled by a speed control module and drives the driving rope pulley by 90-degree reversal of a reducer to drive the rope climbing device to ascend or descend, and the stop button is pressed after a destination is reached.

8. The rope climbing method of the portable powered rope climbing device according to claim 7, characterized in that: groove-over spiral matching rotation is carried out between the climbing rope in the driving rope pulley and a reversing rope pulley, which forces the climbing rope not to carry out relative sliding in relation to the driving rope pulley.

9. The rope climbing method of the portable powered rope climbing device according to claim 7, characterized in that: gaps between the upper and lower rope-pressing pulleys in the warp brake rope-pressing pulley block and the driving rope pulley are larger than the diameter of the climbing rope.

* * * * *